US005899357A

United States Patent [19]

Yuyama et al.

[11] Patent Number: 5,899,357

[45] Date of Patent: May 4, 1999

[54] AMPULE DISPENSER

[75] Inventors: Shoji Yuyama; Nakaji Takeda, both of Toyonaka, Japan

[73] Assignee: Kabushiki Kaisha Yuyama Seisakusho, Osaka, Japan

[21] Appl. No.: 08/834,122

[22] Filed: Apr. 14, 1997

[51] Int. Cl.[6] ..... B23Q 7/12

[52] U.S. Cl. ..... 221/171; 221/236; 221/254; 221/266

[58] Field of Search ..... 221/171, 173, 221/196, 200, 236, 237, 254, 263, 266

[56] References Cited

U.S. PATENT DOCUMENTS

| | | | |
|---|---|---|---|
| 910,246 | 1/1909 | Travis | 221/266 |
| 2,193,211 | 3/1940 | Taylor | 221/266 |
| 2,233,118 | 2/1941 | Williams | 221/266 |
| 2,752,028 | 6/1956 | Maskowitz et al. | 221/171 |
| 2,949,998 | 8/1960 | Whitecar | 221/171 |
| 5,704,516 | 1/1998 | Yuyama | 221/171 |

*Primary Examiner*—H. Grant Skaggs
*Attorney, Agent, or Firm*—Wenderoth, Lind & Ponack, L.L.P.

[57] ABSTRACT

An ampule dispenser for dispensing ampules from an ampule container in which a plurality of ampules are stored in a disorderly manner. It has a stocker for stocking ampules discharged from the ampule container. The stocker has a bottom wall sloping downward both in a first direction in which ampules are discharged from the ampule container and in a second direction perpendicular to the first direction. A cylindrical rotor is provided in the bottom wall at one side thereof for rotation in one direction. The rotor has axial grooves formed in the outer periphery thereof and extending axially to receive a single ampule discharged at a time.

2 Claims, 3 Drawing Sheets

AMPULE DISPENSER

BACKGROUND OF THE INVENTION

This invention relates to an ampule dispenser for discharging ampules one by one.

Ampule dispensers for storing ampules and capable of discharging necessary numbers of ampules are disclosed in unexamined Japanese utility model publication 5-86873 and examined Japanese utility model publication 6-14753.

As ampules are discharged from a cartridge one by one, the cartridge will eventually become empty. Thus, new ampules have to be supplied into the cartridge.

Since new ampules have to be placed in an orderly manner in the cartridge, it is immensely troublesome and time-consuming to supply new ampules into the cartridge.

Examined Japanese utility model publication 6-65329discloses an injection drug dispenser comprising an upper inclined cylindrical member, a lower cylindrical member rotatably connected to the bottom of the upper cylindrical member, and an angle member mounted in the lower cylindrical member along its inner periphery. The lower cylindrical member has its bottom opening closed by a bottom plate formed with a discharge port. Ampules sliding down from the upper cylindrical member into the lower cylindrical member are scooped up and carried circumferentially by the angle member, and discharged through the discharge port when each ampule aligns with the port.

With this arrangement, even if ampules are stored in a disorderly manner, the angle member mounted in the lower cylindrical member arranges ampules in an orderly manner when it scoops up and discharges ampules. Thus, ampules can be replenished easily.

With this injection drug dispenser, ampules supported by the angle member are dropped through the discharge port with the lower cylindrical member in rotation. Thus, ampules are raised by the angle member when they pass through the discharge portion. This increases the possibility of the discharge port being clogged with ampules or ampules being broken.

An object of this invention is to provide an ampule dispenser which can discharge ampules stored in a disorderly manner in an ampule container one by one without breaking them.

SUMMARY OF THE INVENTION

According to this invention, there is provided an ampule dispenser comprising an ampule container in which a plurality of ampules are stored in a disorderly manner, a discharge means for discharging the ampules from the ampule container, a stocker for stocking ampules discharged from the ampule container, the stocker comprising a bottom wall sloping downward both in a first direction in which ampules are discharged from the ampule container and a second direction perpendicular to the first direction, a cylindrical rotor provided in the bottom wall at one side thereof for rotation in one direction, the rotor having axial grooves formed in an outer periphery thereof and extending axially to receive a single ampule discharged from one side of the bottom wall at a time, and a chute provided under the one side of the bottom wall for receiving ampules discharged from the grooves formed in the rotor with the rotation as the rotor rotates.

The rotor is preferably formed with helical stepped portions on its outer periphery.

Other features and objects of the present invention will become apparent from the following description made with reference to the accompanying drawings, in which:

DETAILED DESCRIPTION OF THE PREFERRED EMBODIMENT

The embodiment of this invention will now be described with reference to the accompanying drawings.

Figure 1:
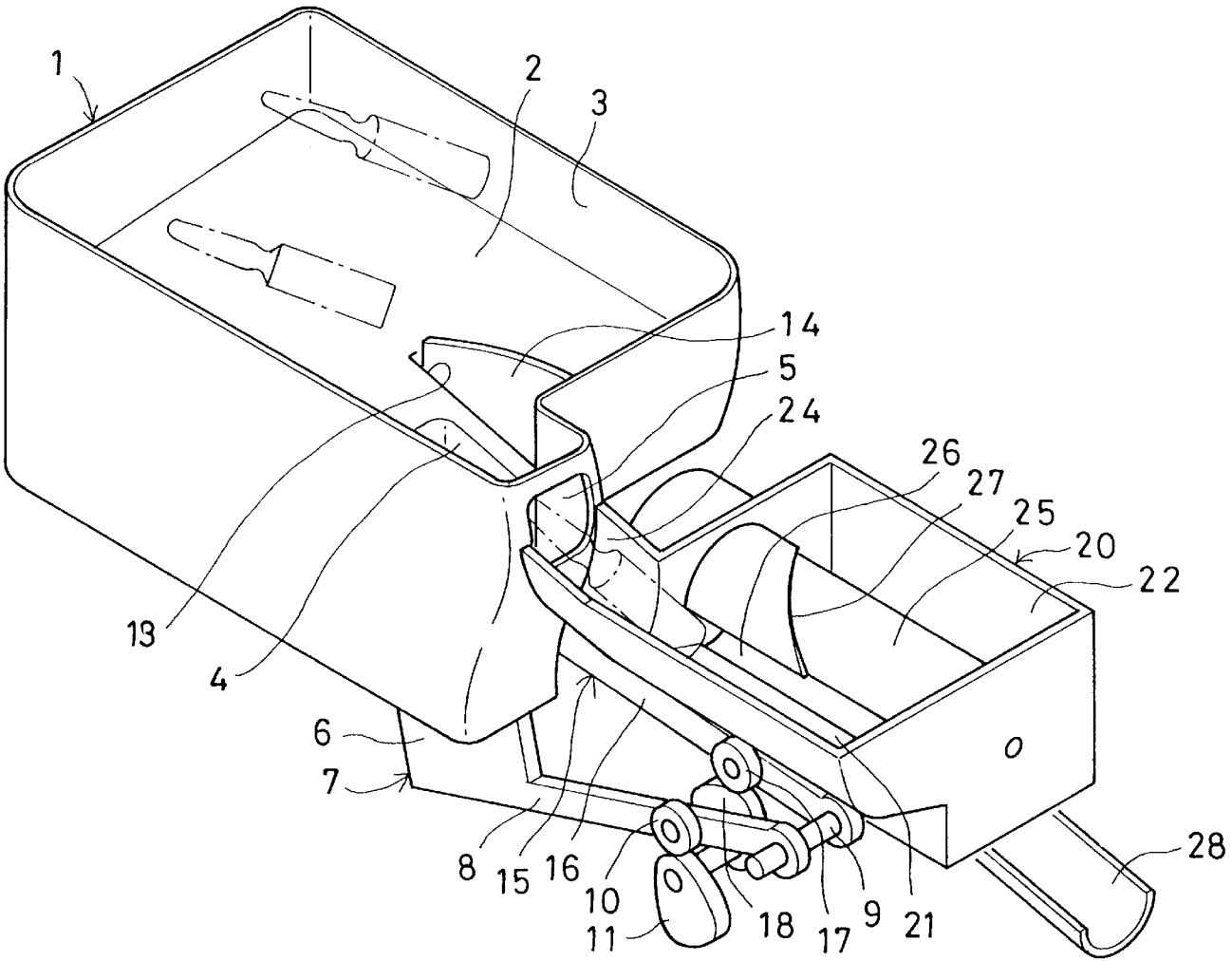
FIG. 1 is a perspective view of an embodiment of the ampule dispenser according to this invention.
Figure 2:
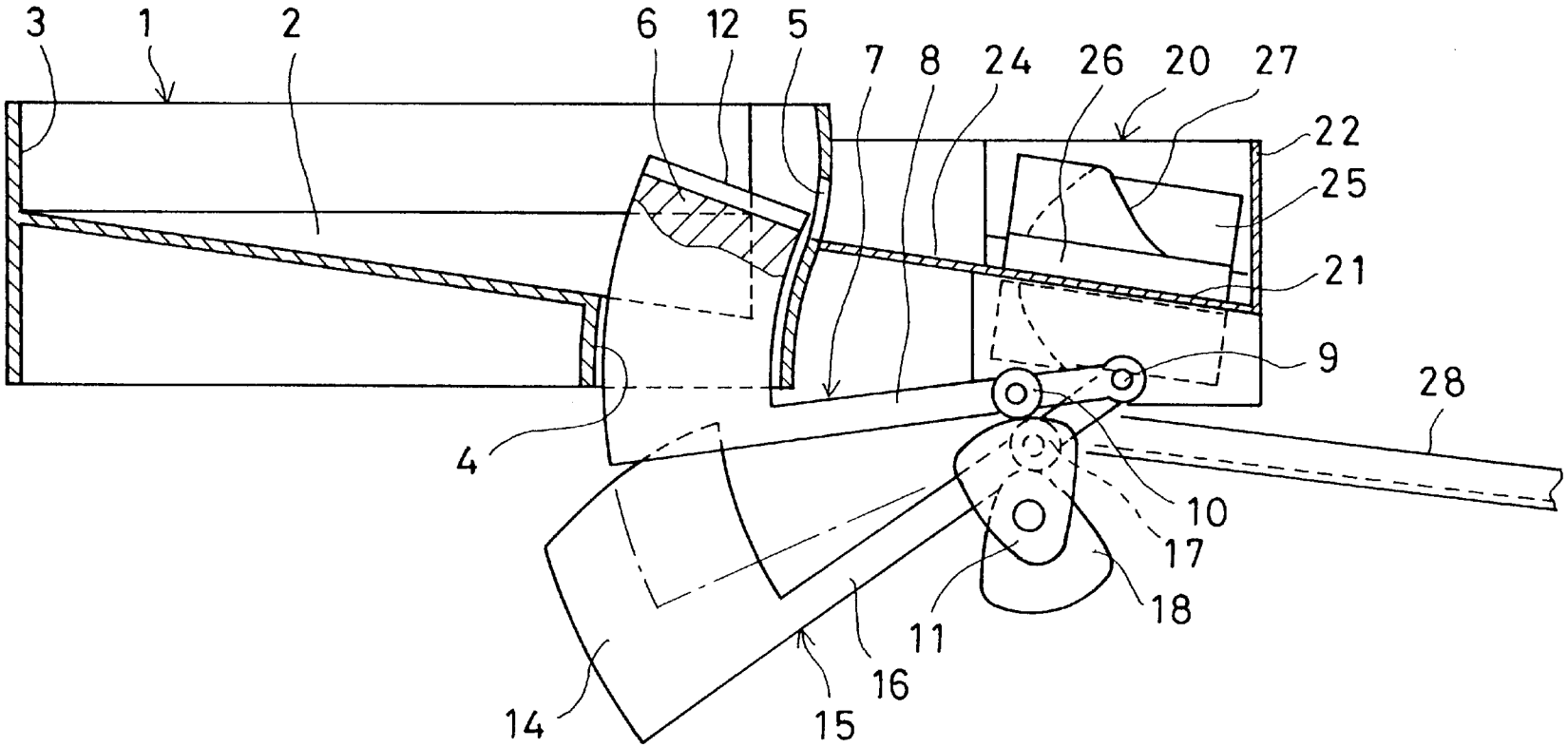
FIG. 2 is a front view in vertical section of the same.
Figure 3:
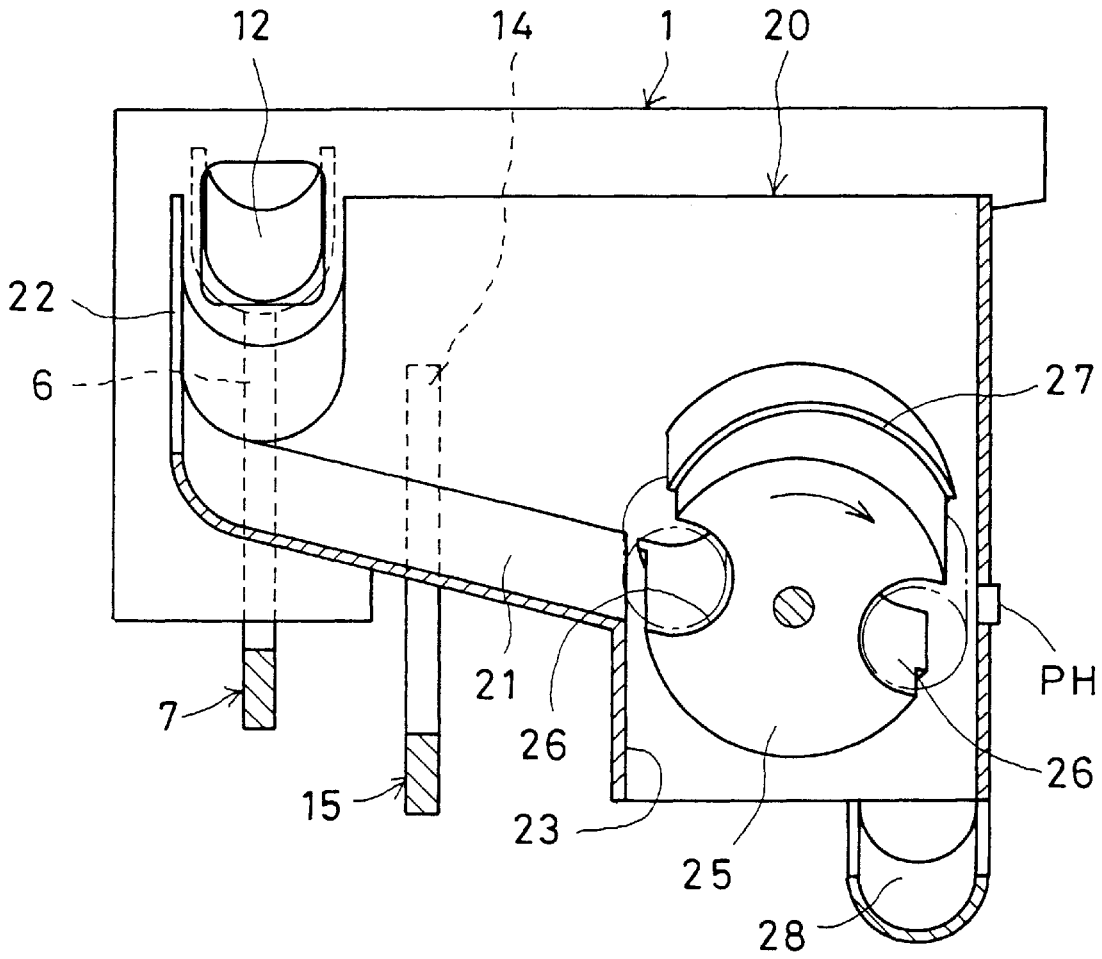
FIG. 3 is a side view in vertical section of the same.

Referring first to FIG. 1, an ampule container 1 comprises a bottom wall 2 and a peripheral wall 3. A hole 4 is formed in the bottom wall 2 along the peripheral wall 3. An ampule supply opening 5 is formed in the peripheral wall 3 above the hole 4. The top surface of the bottom wall 2 slopes downward toward the hole 4 so that ampules in the container 1 will slide toward and drop into the hole 4.

A pusher 6 is inserted in the hole 4 so as to be moved up and down by an elevator means 7 comprising an arm 8 having its one end coupled to the bottom of the pusher 6 and the other end pivotably supported on a pin 9. The arm 8 carries a cam follower 10 at its intermediate portion which is in contact with the outer periphery of a cam 11 that rotates in one direction. The pusher 6 has a groove-shaped top surface 12 which can support a single ampule at a time. When the pusher 6 is raised to its upper limit, its top surface 12 slopes downward toward the opening 5, aligning with the opening 5, so that the ampule on the top surface 12 slides down into the opening 5 and is discharged therethrough.

A second hole 13 is formed at the side of the hole 4. A stirring member 14 is inserted in the second hole 13 in parallel to the pusher 6. The stirring member 14 is moved up and down by a second elevator means 15 comprising an arm 16 having its one end coupled to the bottom of the stirrer 14 and the other end pivotably supported on the pin 9. The arm 16 carries a cam follower 17 at its intermediate portion which is in contact with the outer periphery of a cam 18 that rotates in the same direction as the cam 11 while remaining 180° out of phase with the cam 11. By moving up and down, the stirrer 14 stirs the ampules in the container 1, thus preventing the opening 5 from being clogged with ampules.

A stocker 20 is provided at the side of the container 1. The stocker 20 comprises a bottom wall 21 and a peripheral wall 22. An opening 23 is formed between a side edge of the bottom wall 21 and the peripheral wall 22. The peripheral wall 22 is formed with a groove 24 for receiving ampules discharged from the container 1 through its opening 5. The bottom wall 21 slopes downward both in the direction in which ampules are discharged from the container 1 and a direction perpendicular to this direction so that ampules in the stocker 20 will slide down toward the opening 23 and drop into the opening 23.

A cylindrical rotor 25 is mounted in the opening 23 so as to be rotatable in one direction. The rotor 25 has both ends thereof supported on the peripheral wall 22. A pair of axial grooves 26 are formed in the outer periphery of the rotor 25 at diametrically opposite positions to each other. A single ampule discharged from one side of the bottom wall 21 can fit in each groove 26 at a time. Helical stepped portions 27 are formed on the outer periphery of the rotor 25 to extend from both of its ends to its center. As the rotor 25 rotates, any standing ampules in the stocker 20 will fall down flat guided by the stepped portions 27.

As the rotor 25 rotates, ampules are discharged from the grooves 26 into a chute 28 provided under one side of the rotor 25. The chute 28 slopes downward toward its leading end, so that ampules in the chute 28 slide down toward its leading end and are discharged. A sensor PH for counting ampules discharged is provided on the peripheral wall 22 over the chute 28.

In operation, numerous ampules stored in the container in a disorderly manner, slide along the bottom wall 2 toward the hole 4. With one of these ampules on the top surface 12 of the pusher 6, the pusher is pushed up. When the pusher is raised to its upper limit, the ampule on the top surface 12 is discharged through the opening 5 and the groove 24 into the stocker 20.

The ampules in the stocker 20 slide down the bottom wall 21 and fit one after another into the grooves 26 formed in the rotor 25. With the rotation of the rotor 25, ampules in the grooves 26 are discharged into the chute 28 and then drop from the leading end of the chute 28. Since the number of ampules discharged from the grooves 26 is counted by the sensor PH, it is possible to accurately discharge a required number of ampules.

A sensor for detecting ampules may be provided on the bottom wall 21 to stop the pusher 6 if the sensor keeps detecting ampules for a predetermined time, which is the time needed for the rotor 25 to make a half revolution.

According to this invention, the rotor is formed with grooves in which a single ampule can fit at a time so that ampules can be discharged one by one from the grooves by rotating the rotor. It is thus possible to discharge ampules stored in a disorderly manner in the container one by one without breaking them.

As the rotor rotates, any standing ampules in the stocker will fall down flat guided by the stepped portions 27. Thus, it is possible to smoothly discharge ampules.

What is claimed is:

1. An ampule dispenser comprising an ampule container in which a plurality of ampules are stored in a disorderly manner, a discharge device for discharging the ampules from said ampule container, a stocker for stocking ampules discharged from said ampule container, said stocker comprising a bottom wall sloping downward both in a first direction in which ampules are discharged from said ampule container and a second direction perpendicular to said first direction, a cylindrical rotor provided in said bottom wall at one side thereof for rotation in one direction, said rotor having axial grooves formed in an outer periphery thereof and extending axially to receive a single ampule discharged from one side of said bottom wall at a time, and a chute provided under said one side of said bottom wall for receiving ampules discharged from said grooves formed in said rotor as said rotor rotates.

2. An ampule dispenser as claimed in claim 1 wherein said rotor is formed with helical stepped portions on its outer periphery.

* * * * *